US008371897B1

(12) United States Patent
Wong

(10) Patent No.: US 8,371,897 B1
(45) Date of Patent: Feb. 12, 2013

(54) VISION TECHNOLOGY FOR INTERACTIVE TOYS

(75) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

(21) Appl. No.: 13/353,672

(22) Filed: Jan. 19, 2012

(51) Int. Cl.
*A63H 30/00* (2006.01)

(52) U.S. Cl. ..... 446/175; 382/103; 446/484; 446/72

(58) Field of Classification Search ..... 446/175, 446/408

See application file for complete search history.

(56) References Cited

U.S. PATENT DOCUMENTS

| | | | | |
|---|---|---|---|---|
| 5,555,071 | A * | 9/1996 | Koenig et al. | 396/155 |
| 6,160,986 | A * | 12/2000 | Gabai et al. | 434/308 |
| 6,175,772 | B1 * | 1/2001 | Kamiya et al. | 700/31 |
| 7,062,073 | B1 * | 6/2006 | Tumey et al. | 382/118 |
| 7,068,941 | B2 * | 6/2006 | Fong et al. | 398/107 |
| 7,551,980 | B2 * | 6/2009 | Sakagami et al. | 700/258 |
| 2011/0269365 | A1 * | 11/2011 | Goff et al. | 446/72 |
| 2012/0083182 | A1 * | 4/2012 | Heatherly et al. | 446/175 |

* cited by examiner

*Primary Examiner* — Tramar Harper
(74) *Attorney, Agent, or Firm* — Greenberg Traurig, LLP

(57) ABSTRACT

An interactive toy comprises a body having a non-reactive portion and a reactive portion. There is a CMOS image sensor with the body for capturing an image in the vicinity of the body. A microprocessor processes the captured image and generates instructions in response to the processed image. The instructions cause operation of the reactive portion of the body. The toy can be a doll including a plush, soft or hard plastic head and body; and the CMOS image sensor has a resolution of about or selectively less than 1M pixels.

25 Claims, 12 Drawing Sheets

VISION TECHNOLOGY FOR INTERACTIVE TOYS

FIELD OF THE DISCLOSURE

The disclosure relates to a toy that can interact with a user of the toy.

BACKGROUND

Gesture recognition is used in different applications such as Xbox Kinect, Nintendo Wii remote controller and iPhone. The ability to track human movement can be detected by different sensors. Depth-aware cameras are expensive to be applied in toy. There is a significant increase in use of visual technology due to the availability of relatively low-cost image sensors and the computing hardware, and the present disclosure is concerns this technology as applied to toys.

SUMMARY

An interactive toy comprises a body having a non-reactive portion and a reactive portion. There is a CMOS image sensor with the body for capturing an image in the vicinity of the body. A microprocessor processes the captured image and generates instructions in response to the processed image. The instructions cause operation of the reactive portion of the body.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which.

DETAILED DESCRIPTION

Figure 1:
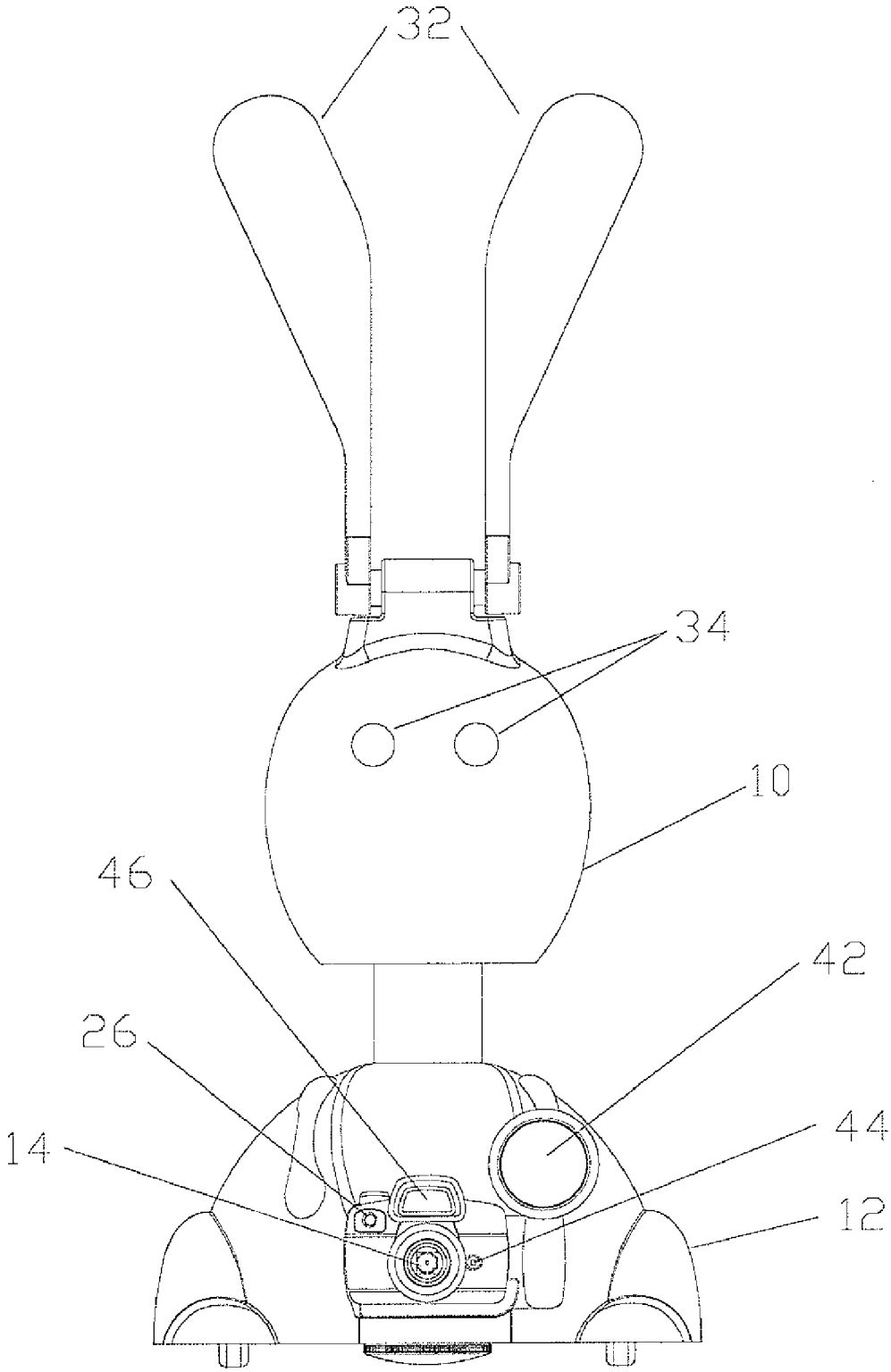
FIG. 1 illustrates the front view with parts broken away of a design of a toy doll showing a button, LED, CMOS Sensor, and Mirror.
Figure 2:
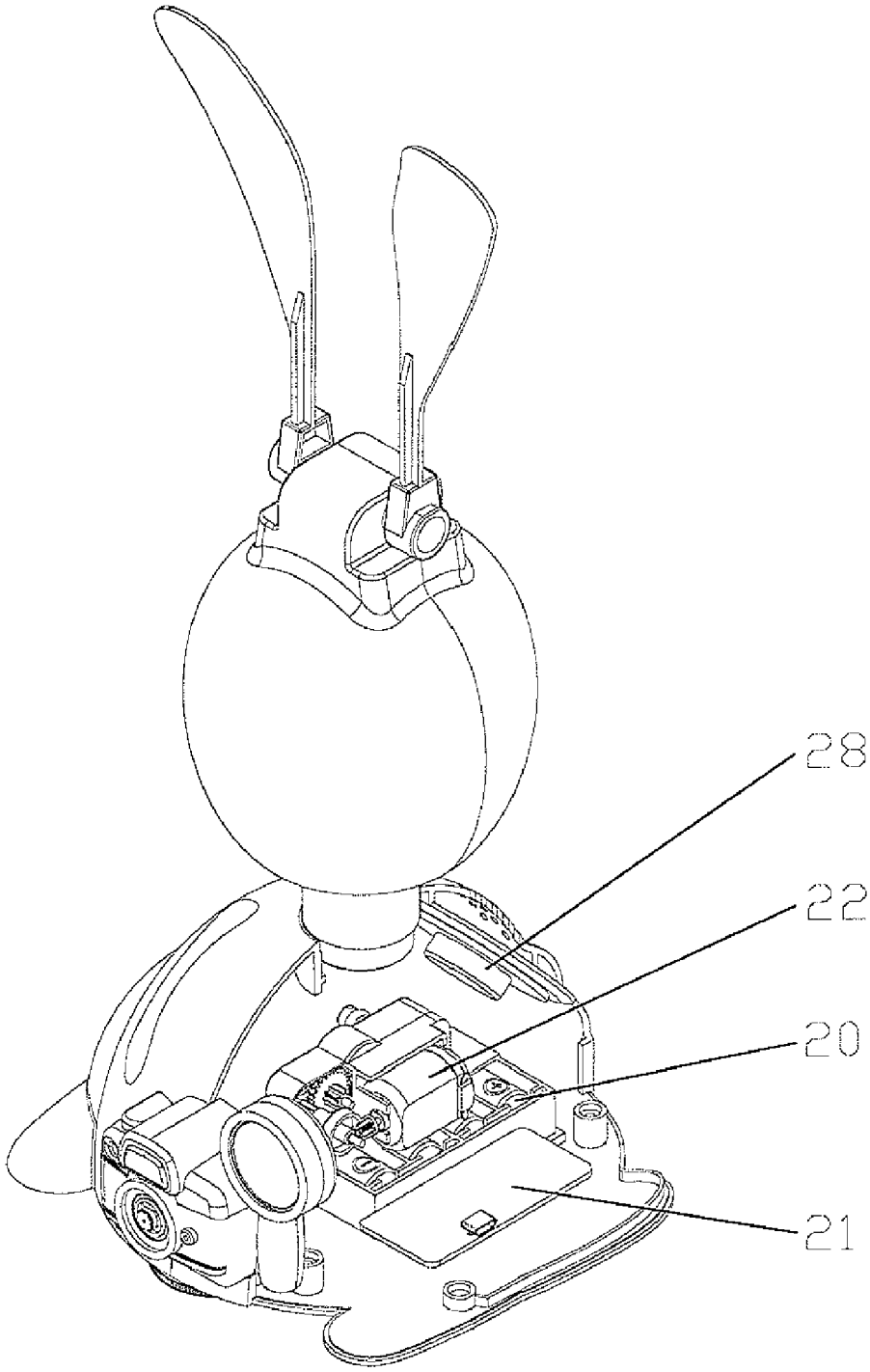
FIG. 2 illustrates the perspective view with parts broken away of a design of a toy doll showing a speaker, motor and gearbox, battery pack, PCBA.
Figure 3:
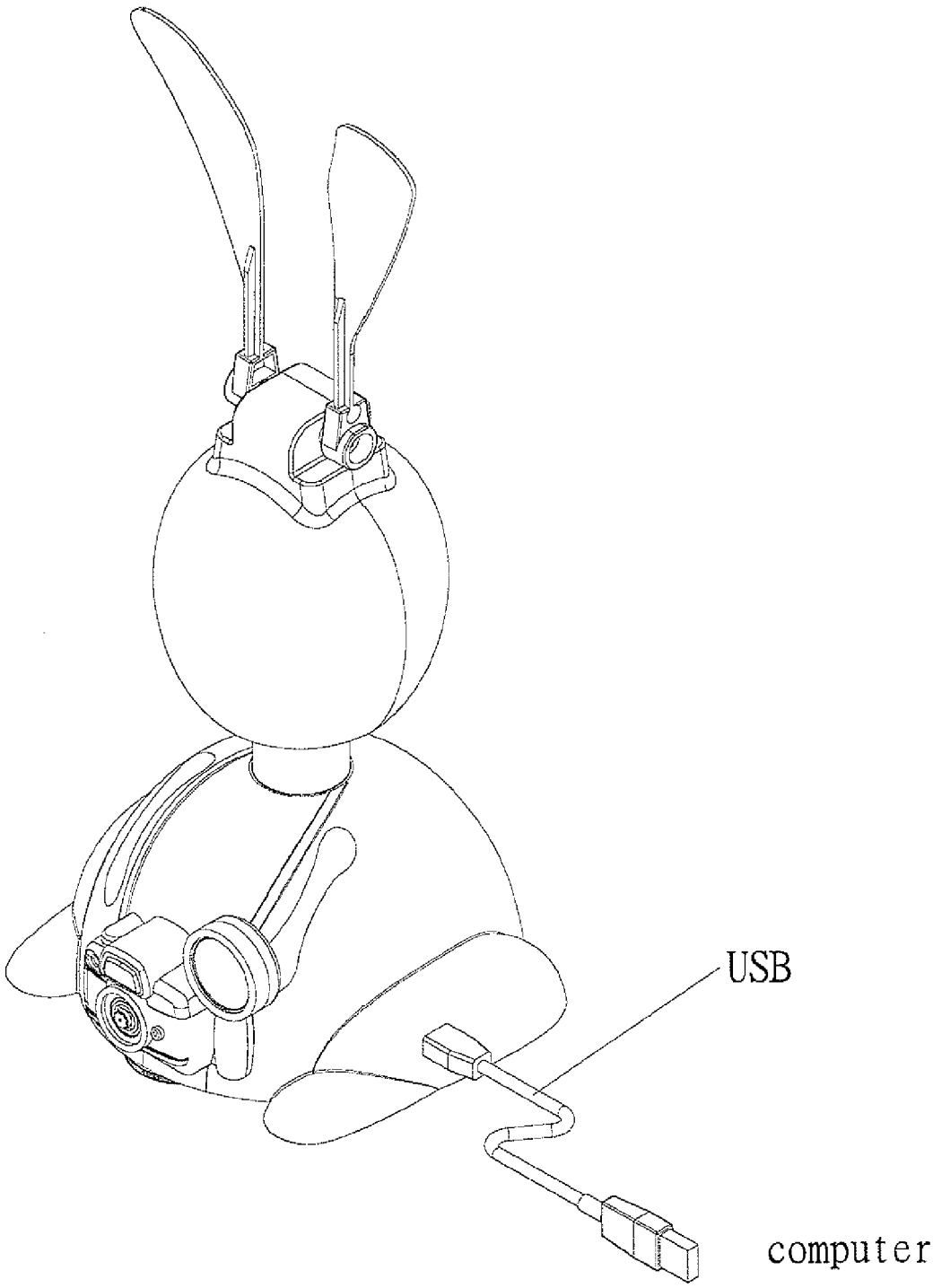
FIG. 3 illustrates the perspective view with parts broken away of a design of a toy doll showing a USB connection to a computer.
Figure 4:
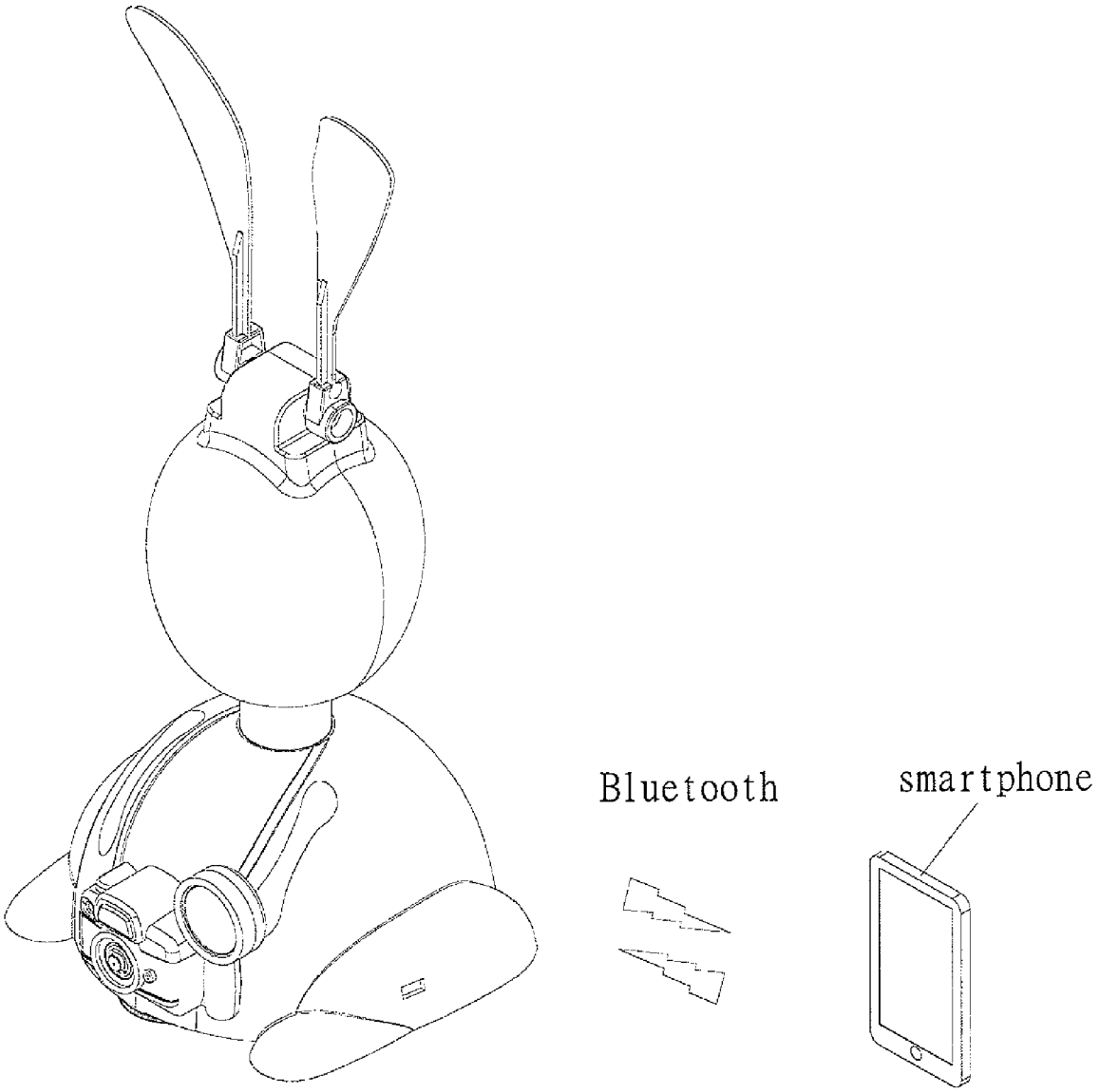
FIG. 4 illustrates the perspective view with parts broken away of a design of a toy doll showing a Bluetooth connection to a Smartphone.
Figure 5:
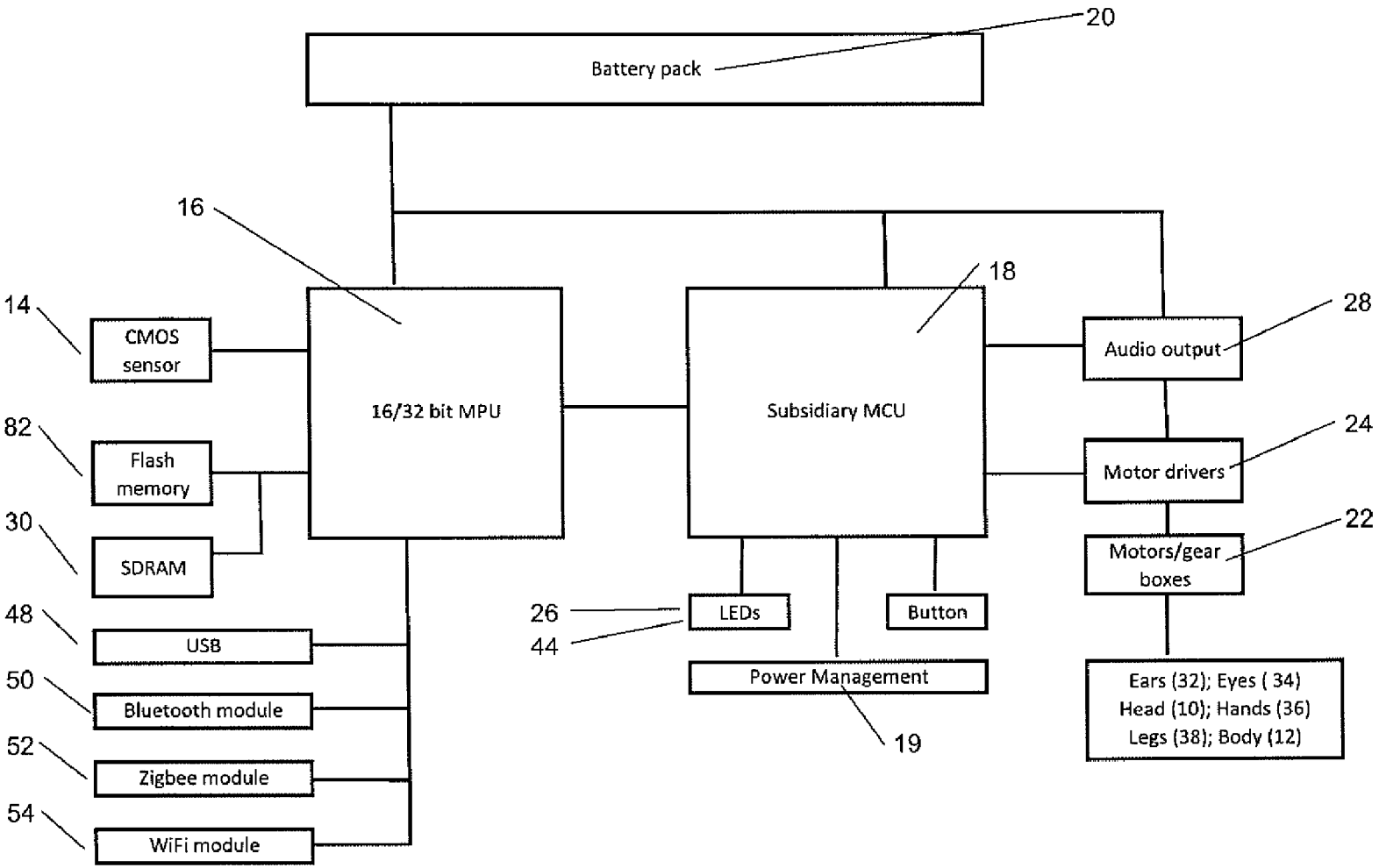
FIG. 5 illustrates a block diagram of components of the toy.
Figure 6:
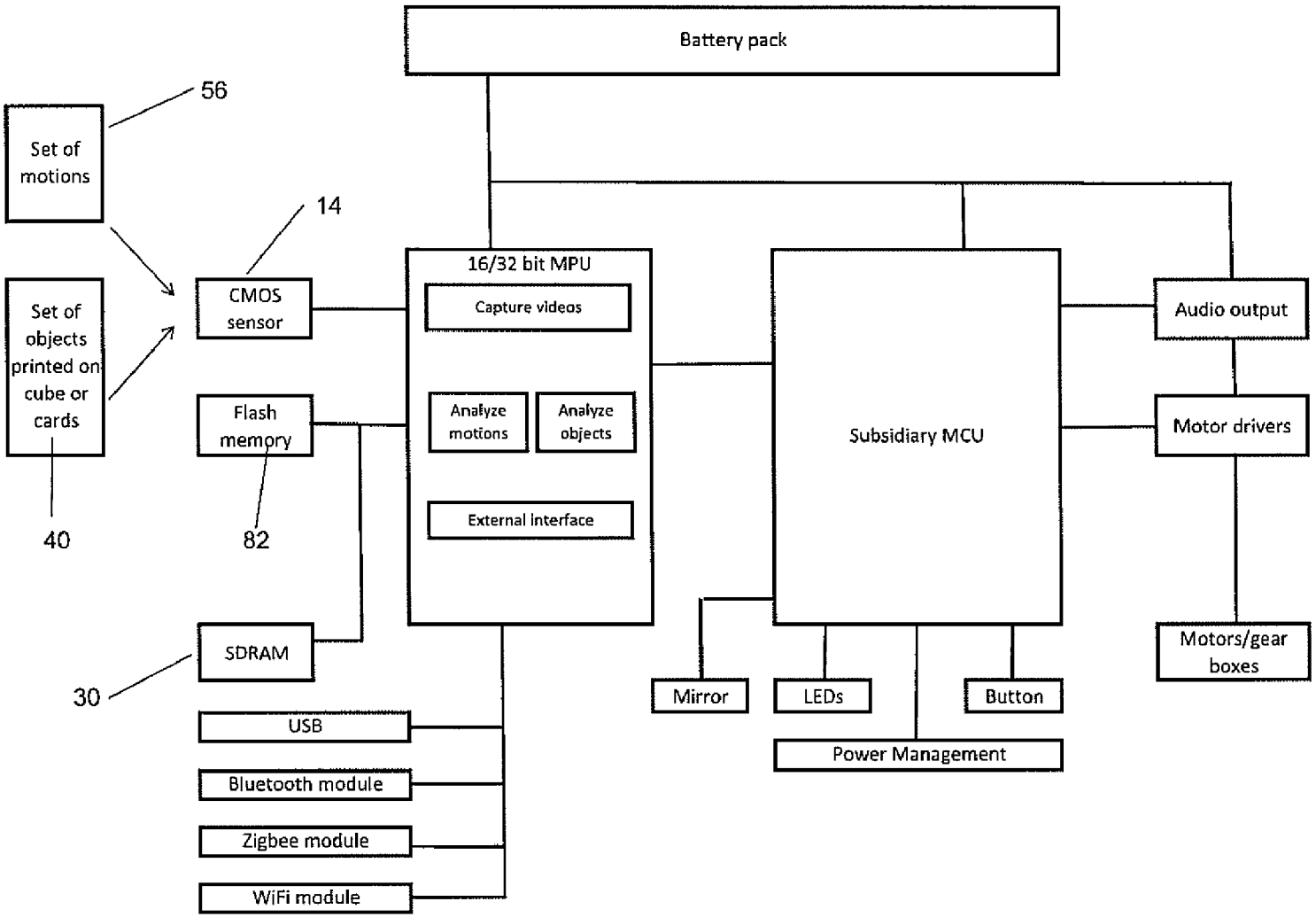
FIG. 6 illustrates a block diagram showing analysis components relative to a set of objects.

The disclosure is directed to an interactive toy comprising a body having a non-reactive portion and a reactive portion; a CMOS image sensor with the body for capturing an image in the vicinity of the body; and a microprocessor for processing the captured image and generating instructions in response to the processed image, the instructions being for causing operation of the reactive portion of the body.

The microprocessor includes a routine for analyzing a pattern of motion in the vicinity of the body, and classifying the pattern into different predefined categories of motion.

The categories of motion are motion of a human and are selected from the group consisting of crouching down, standing up, jumping, raising one arm, raising two arms, waving one arm, waving two arms, clapping a hand, shaking a head, nodding a head, and relative non-motion.

The microprocessor includes a routine for analyzing predefined objects in the vicinity of the body, and classifying the objects into different predefined categories.

The categories of the object are selected from the group consisting of shapes, numbers, animals, fruits, colors and letters or a combination of these objects in a same picture.

The object analysis permits the identification of an object independently of the object orientation.

The interactive toy includes a second microprocessor, the second microprocessor being selected to operate features selected from the group consisting of handling power management of the toy, controlling at least one motor of the toy, driving an LED and playing sound effect, melody, song and message associated with the toy.

There can be an external memory for data and program storage, and for interacting with the microprocessor.

The interactive toy can include multiple motors and multiple gear boxes respectively, each motor and gearbox being for effecting movement of an element of the reactive portion, the element being at least one of ears, eyes, head, hands, legs or other body component.

The objects can include multiple pictures, each picture being representable as a respective picture card or cube, the respective card or cube being formed with a respective different category selected from the group consisting of a recognizable shape, number, animal, fruit, color or letter.

There can be at least one of a mirror or a light beam from an LED mounted in the body, the location of the mounting being for guiding a user of the toy to face the image sensor.

There can also or alternatively be a LCD located such as promote alignment or guiding a user of the toy relative to the image sensor thereby to effect a display on a screen of the image sensor.

The interactive toy can include a button or human gesture command element, the operation of the button or element being for use to select respectively different games for the toy.

The microprocessor can analyze moving pixels of the sensor thereby to monitor the relative position and moving patterns of pixels, and to infer a connection with a body part of a user of the toy, thereby having the toy be user independent and not require training the toy for use respective to a user.

The microprocessor can include a routine for capturing a video sensed by the image sensor, the video being at a frame rate of about, and selectively not more than, 20 frames per second.

The microprocessor can include a routine for limited recognition of actions of a single user relative to a static background.

The microprocessor can include a routine for being operable when the body parts or objects are relatively fully visible, and having an aperture of a lens on the image sensor formed whereby the operation of the microprocessor is effectively functional when the user is within 1.5 meters from the image sensor.

The image sensor can include a processor having the characteristic of a digital camera thereby to permit capture of an image on the image sensor, and storage of the image as a photograph of a user of the toy, and the processor permitting storage of the image in an external memory.

The microprocessor can be a 16- or 32-bit MPU for image analysis. There can be a communication module wherein the toy is connectable with a digital input device thereby to link the toy with digital input device through at least one of a USB, Bluetooth, Zigbee or WiFi communication protocol whereby the toy is configured to receive at least one of a predefined object set, voice, melody, song or sound effect from the digital input device.

The interactive toy can include a at least one of a microphone sensor for speech recognition input, capacitive sensor for reaction to a touching input, or a proximity sensor for detecting when a user is located at a predetermined distance from the toy.

The microprocessor can include a routine for interactive game play, the routine causing the toy to relate to a user the need to perform one action, and then checking whether the action has been correctly performed. The toy includes a routine for determining the right action relative to a preprogrammed pattern, and providing feedback to a user by causing the toy to react with different selected movements, the movement including selectively at least one of shaking or nodding of a reactive portion or an emission of a sound output.

The interactive toy can be a doll including a plush, soft or hard plastic head and body; and the CMOS image sensor has a resolution of about or selectively less than 1M pixels.

In one embodiment a vision-based toy doll comprises:

(1) a plush, soft or hard plastic head 10 and body 12;

(2) a low cost CMOS image sensor 14 in which the resolution is usually below 1M pixels; and (3) a 16-bit or 32-bit Microprocessor (MPU) or Digital Signal Processor (DSP) for image data manipulation.

It further includes analyzing the pattern of motions and classifying them into different actions such as crouch down, stand up, jump, raise one arm, raise two arms, wave one arm, wave two arms, clap the hand, shake head, nod head or even freeze etc.

Analyzing sets of predefined object in different categories such as shapes, numbers, animals, fruits, colors or letters or a combination of these objects in the same picture. The object analysis means that the toy is able to identify the object no matter the picture's orientation.

One or more subsidiary MCUs 18 are provided for handling power management 19 provided through a battery 20, controlling motors and gear boxes 22 through motor drivers 24, driving LEDs 26 and playing sound effect, melody, song and messages through an audio output 28.

There are:

external SDRAM and Flash memory devices 30 and 82 respectively for data and program storage.

Figure 9:
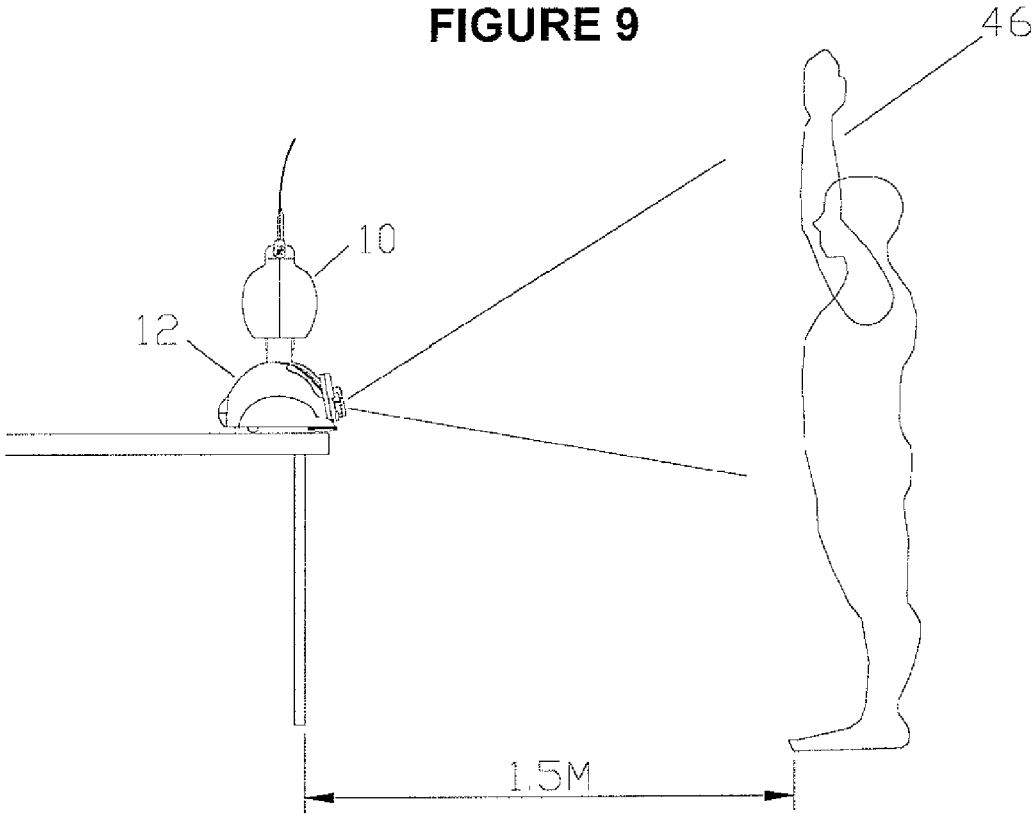
FIG. 9 illustrates a diagrammatic view of the toy relative to a user or player.

At least one motor and gear box 22 for controlling ears 32, eyes 34, head 10, hands, legs or body 12 movement.

objects 40 which are plural or multiple picture cards or in cube form with different categories such as shapes, numbers, animals, fruits, color or letters for recognition.

a mirror 42 or a narrow light beam from LED 44 at front position for guiding the user to face at the image sensor 14. Alternatively, a small LCD can be used. Once the player or user aligns with the image sensor 14, the user's head is displayed on the screen of the sensor 14.

a button 46 or human gesture command as shown in a representation in FIG. 9 is used to select different games and enter a game.

Unlike the high processing power of PC or mobile device, the low computing power of 16-bit or 32-bit MPU does not perform complicated tasks for tracking body skeleton nor have the intelligence to recognize human body parts. It is only used to analyze moving pixels. i.e. to monitor the relative position and moving patterns of pixels to infer which body part they belong. Such method is player independent, i.e it does not require training the toy by collecting a lot of data to build up a database. It works for different ages and genders.

To further reduce the requirement of 16- or 32-bit MPU processing power, this system is limited to capture videos for no more than 20 frames per second. Besides this, it is limited to recognize the actions of single person in static background.

To recognize the actions or objects 40, the body parts 46 or objects 40 are fully visible. Based on the aperture of the lens on the image sensor 14, the user should stay within 1.5 meters from the image sensor 14.

The image sensor 14 is able to act as a digital camera in which it can capture the photo of the user and store the image in external memory such as the SD card.

With a built-in 16- or 32-bit MPU for image analysis, the toy can work in standalone mode. It is possible to link this toy with a computer or any mobile devices through USB 48, Bluetooth 50, Zigbee 52 or WiFi 54 system so that new predefined object sets, voice, melody, song and sound effect etc can be downloaded to the toy.

Apart from gesture input as seen or defined by the set of motions 56, it is also possible for the interactive toy to accompany with microphone sensing 60 for speech recognition input 62, capacitive sensing 64 for touching input and proximity sensing 66 for detecting the child getting closer to the toy and video capturing 68.

Figure 7:
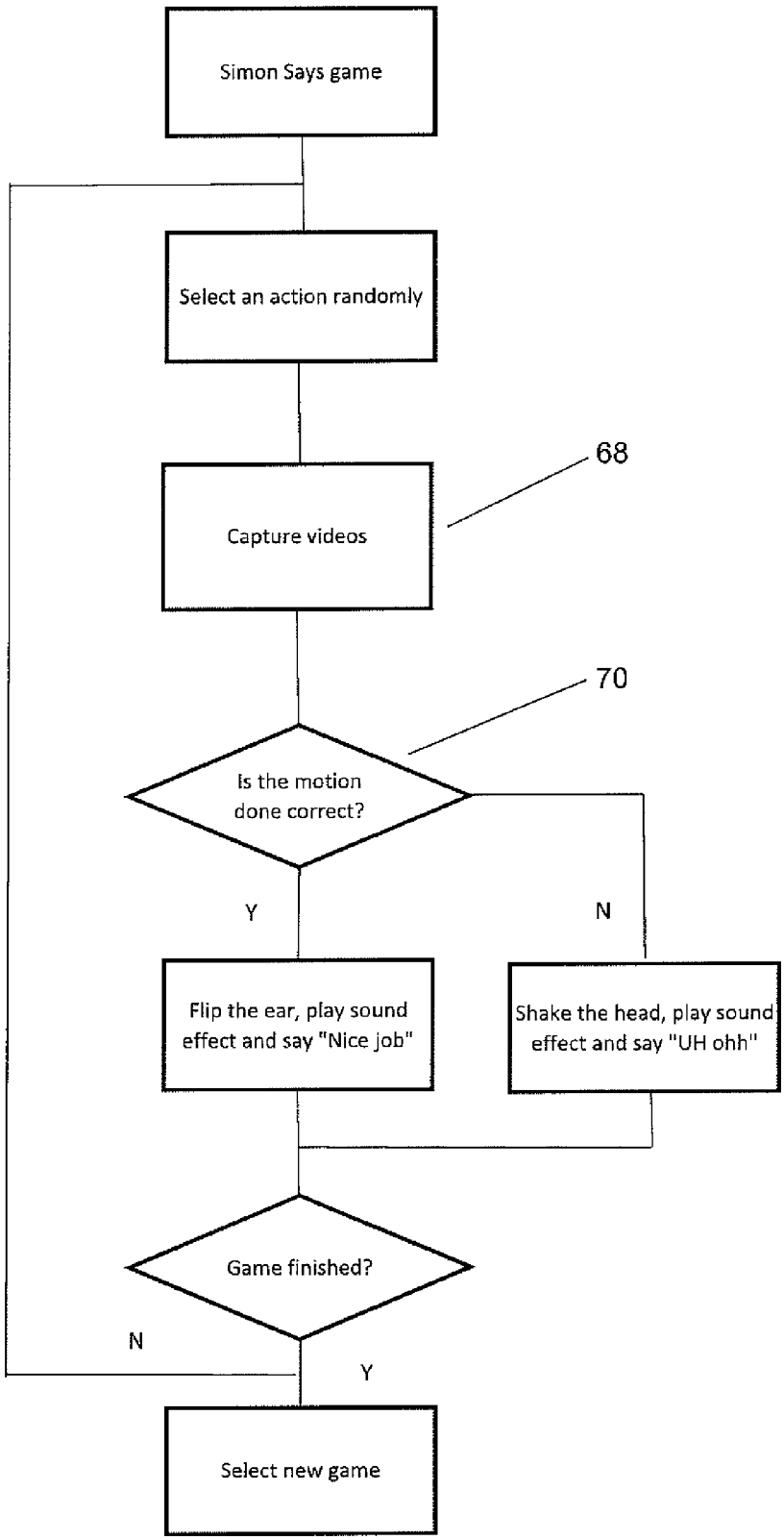
FIG. 7 illustrates a flow diagram of a game operable as part of the toy.
Figure 8:
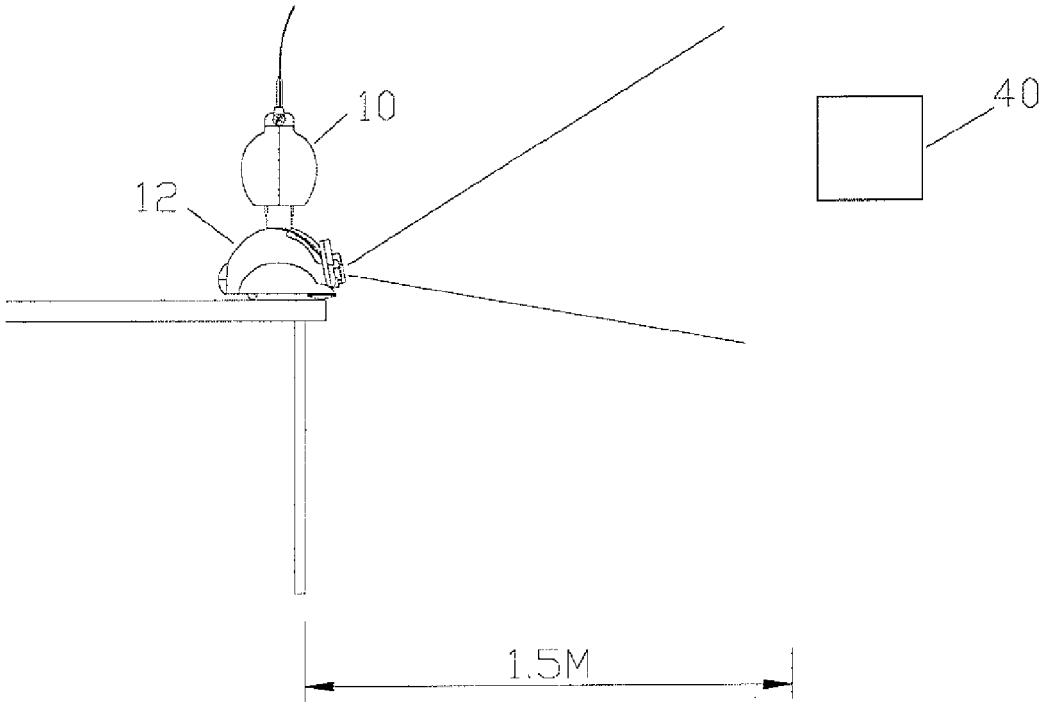
FIG. 8 illustrates a diagrammatic view of the toy relative to an object.

For interactive game play, as illustrated in FIGS. 7 and 9, the toy tells the user to perform one action randomly, and then checks to determine if the user has performed the right action. This can be is the motion done correctly 70 or is the object shown correctly 72. This decision could be easier since we know what patterns that are looking for. In this case, the system can also tolerate more errors and allow more flexibility. The toy can provide feedback to the child by having different movements such as shaking or nodding the head together with a voice output to let the child know whether the answer is correct or not.

In other forms of the disclosure, gesture recognition is used as in different applications recently such as Xbox Kinect, Nintendo Wii remote controller and iPhone. The ability to track human movement can be detected by different sensors. There are three basic types of sensors to observe body or hand gesture. These are: (a) mount-based sensors such as glove-type resistive sensor or Wii remote that equipped with gyro and accelerometer sensor; (b) touch-based sensors such as multi-touch capacitive or resistive sensor on LCD surface of Smartphone; and (c) vision-based sensors such as depth-aware camera in Kinect, stereo camera or normal camera. For the first two types of sensors, contact is required. Cameras can be applied in the toy.

Visual technology due to the availability of low-cost CMOS image sensor and the computing hardware. In present disclosure, vision-based human computer interaction technology is applied to an interactive toy such as plush dolls, pets, animals or action figures. The toy responds to some relatively basic and simple human gestures or responds to predefined pictures input by driving at least one or more motors inside the toy. Together with gear boxes and mechanical levers, the toy performs head, ears, eyes, hands, legs or body movement according to the user's input.

It will be understood that the toy can be formed of a variety materials and may be modified to include additional routines, processes, switches and/or buttons. It will be further understood that a variety of other types of toys and digital inputs may be used to control the operation of the toy of the present disclosure.

One of ordinary skill will appreciate that although the embodiments discussed above refer to one form of image sensor. There can be other forms of active pixel sensors and there could be more than one sensor with the toy and other modes of operation could be used.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

Many of the features of the present disclosure are implemented by suitable algorithms that are executed by one or more the micro processors or controllers with the toy and multiple software routines.

Figure 10:
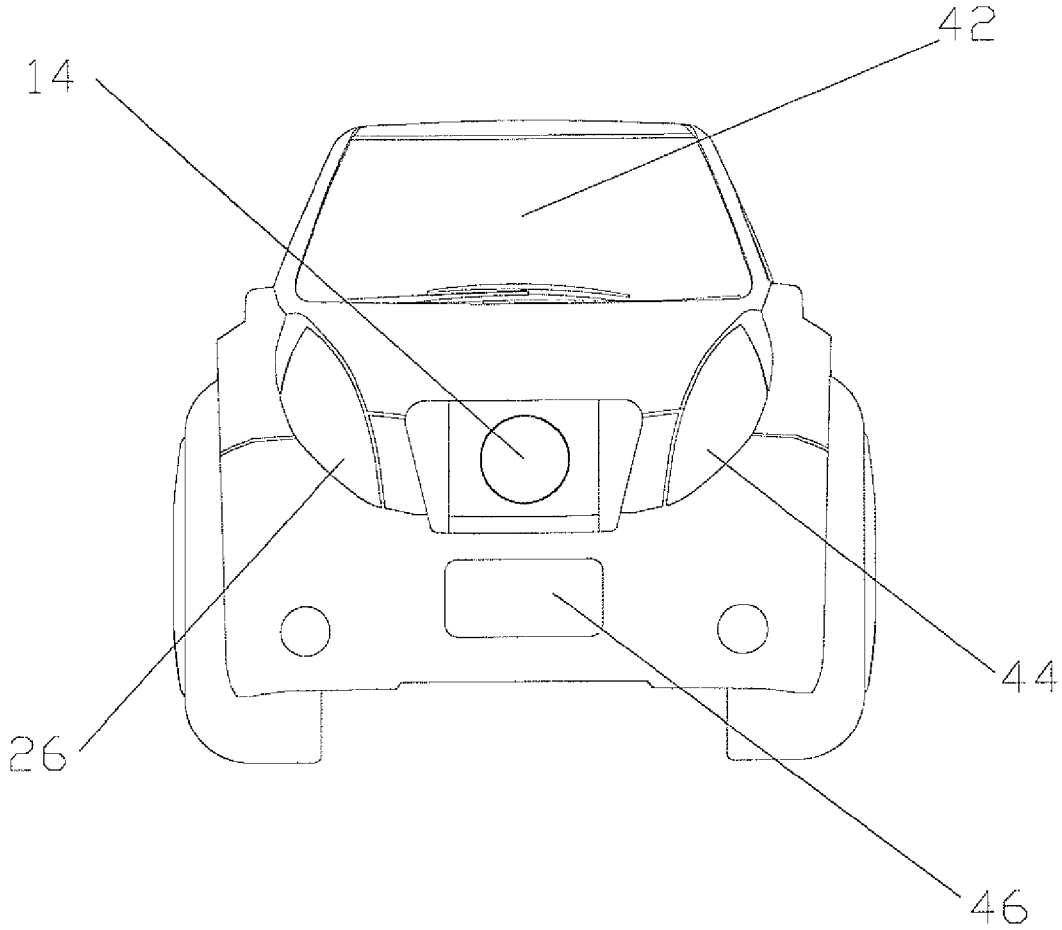
FIG. 10 illustrates the front view with parts broken away of a design of a toy vehicle showing a button, LED, CMOS Sensor, and Mirror.
Figure 11:
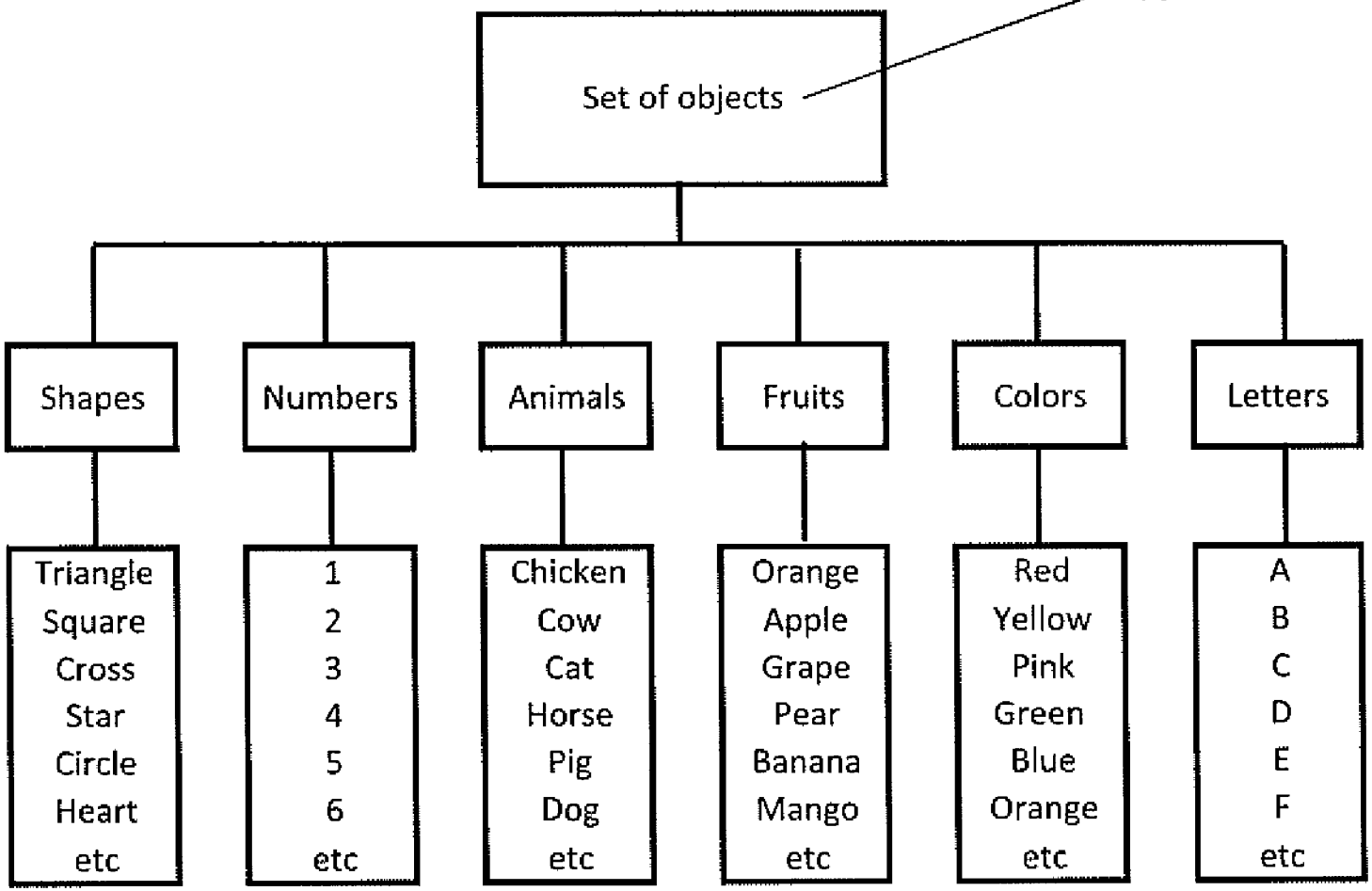
FIG. 11 illustrates a representation of a set of objects.
Figure 12:
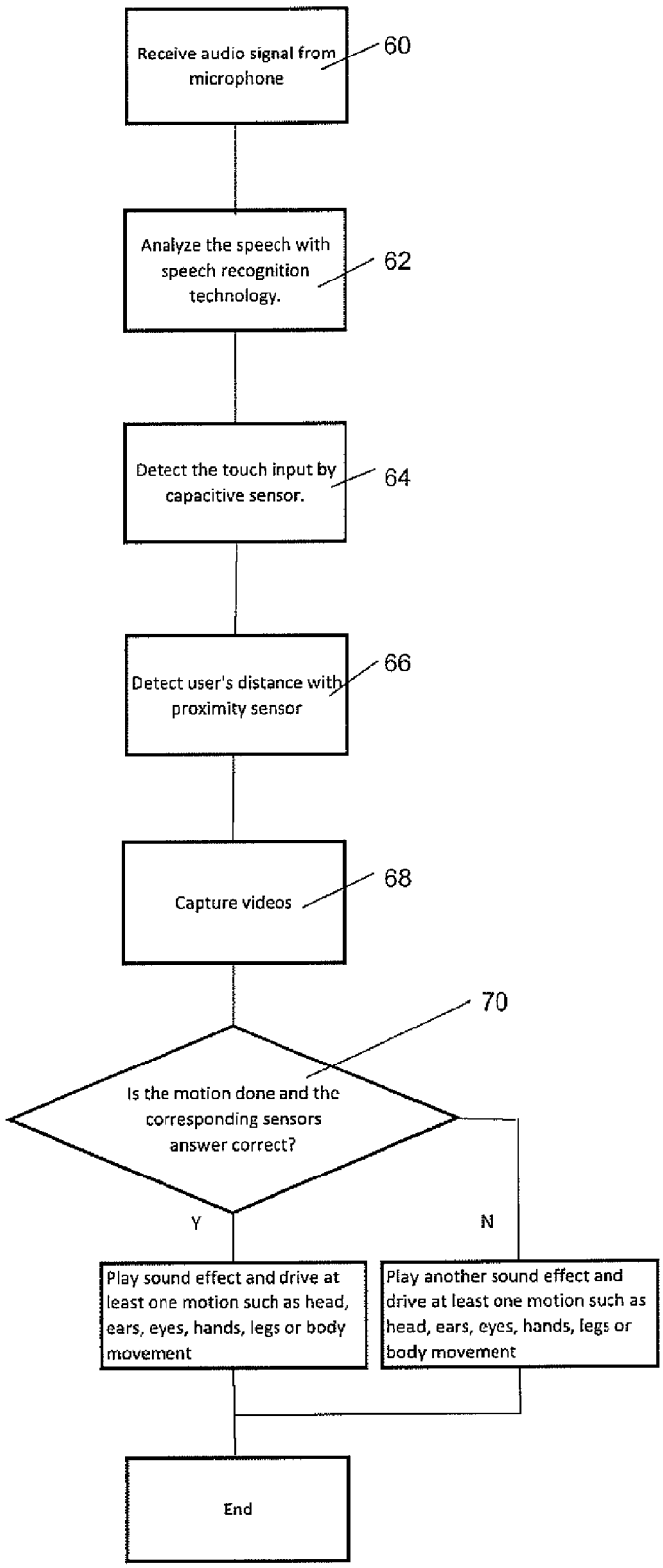
FIG. 12 illustrates a flow diagram of audio sensing, proximity sensing, capacitive sensing and video sensing.
Figure 13:
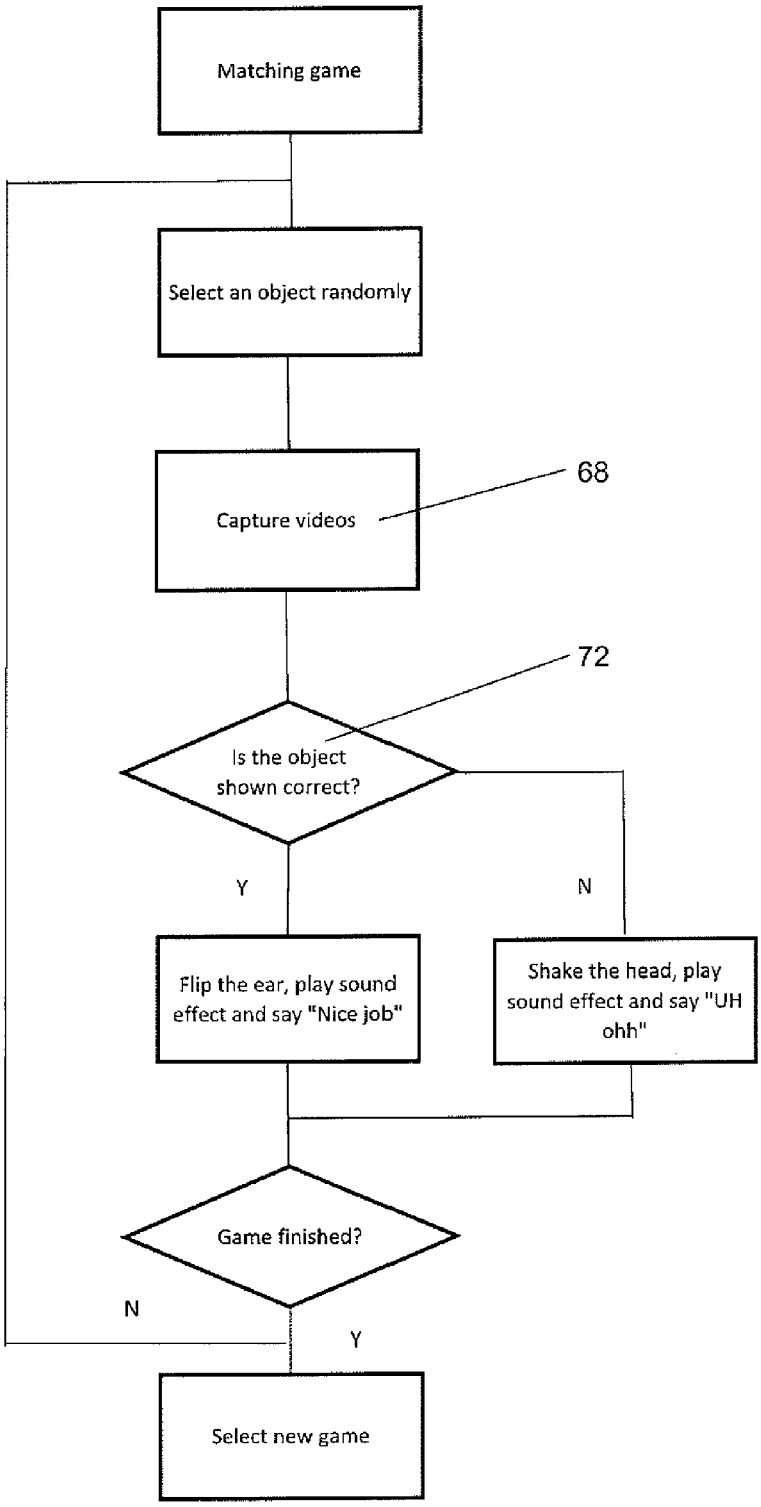
FIG. 13 illustrates a flow diagram of a matching game operable as part of the toy.

Although the disclosure is described of a toy doll, it is possible to apply the disclosure to a wheeled embodiment. As such, the present disclosure could also comprise a vehicle having wheels. This is illustrated in FIG. 10.

The present disclosure may be embodied in specific forms without departing from the essential spirit or attributes thereof. In particular, although the disclosure is illustrated using a particular format with particular component values, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

The invention claimed is:

1. An interactive toy comprising:

a body having a non-reactive portion and a reactive portion;

a CMOS image sensor with the body for capturing an image in the vicinity of the body;

a microprocessor for processing the captured image and generating instructions in response to the processed image, the instructions being for causing operation of the reactive portion of the body;

wherein the microprocessor is for analyzing moving pixels of the sensor thereby to monitor the relative position and moving patterns of pixels, and to infer a connection with a body part of a user of the toy, thereby having the toy be user independent and not require training the toy for use respective to a user;

the microprocessor includes a routine for analyzing predefined objects in the vicinity of the body, and classifying the objects into different predefined categories of shapes, wherein the object analysis permits the identification of an object independently of the object orientation;

at least one actuator for effecting movement of an element of the reactive portion, the element being at least one of ears, eyes, head, hands, legs or other body component;

at least one of a mirror or a light beam from an LED mounted in the body, the location of the mounting being for guiding a user of the toy to face the image sensor; and a human gesture command element, the operation of the element being for use to select respectively different games for the toy.

2. The interactive toy as claimed in claim 1 wherein the microprocessor includes a routine for analyzing a pattern of motion in the vicinity of the body, and classifying the pattern into different predefined categories of motion.

3. The interactive toy as claimed in claim 2 wherein the categories of motion are motion of a human and are selected from the group consisting of crouching down, standing up, jumping, raising one arm, raising two arms, waving one arm, waving two arms, clapping a hand, shaking a head, nodding a head, and relative non-motion.

4. The interactive toy as claimed in claim 1 wherein the microprocessor includes a routine for analyzing predefined objects in the vicinity of the body, and classifying the objects into different predefined categories of shapes.

5. The interactive toy as claimed in claim 4 wherein the categories of the object are selected from the group consisting of shapes, numbers, animals, fruits, colors and letters or a combination of these objects in a same picture.

6. The interactive toy as claimed in claim 4 wherein the objects include multiple pictures, each picture being representable as a respective picture card or cube, the respective card or cube being formed with a respective different category selected from the group consisting of a recognizable shape, number, animal, fruit, color or letter.

7. The interactive toy as claimed in claim 1 including a second microprocessor, the second microprocessor being selected to operate features selected from the group consisting of handling power management of the toy, controlling at least one motor of the toy, driving an LED and playing sound effect, melody, song and message associated with the toy.

8. The interactive toy as claimed in claim 1 including an external memory for data and program storage, and for interacting with the microprocessor.

9. The interactive toy as claimed in claim 1 wherein the microprocessor includes a routine for capturing a video sensed by the image sensor, the video being at a frame rate of about, and selectively not more than, 20 frames per second.

10. The interactive toy as claimed in claim 1 wherein the microprocessor includes a routine for limited recognition of actions of a single user relative to a static background.

11. The interactive toy as claimed in claim 1 wherein the microprocessor includes a routine for being operable when the body parts or objects are relatively fully visible, and having an aperture of a lens on the image sensor formed whereby the operation of the microprocessor is effectively functional when the user is within 1.5 meters from the image sensor.

12. The interactive toy as claimed in claim 1 wherein the image sensor includes a processor having the characteristic of a digital camera thereby to permit capture of an image on the image sensor, and storage of the image as a photograph of a user of the toy, and the processor permitting storage of the image in an external memory.

13. The interactive toy as claimed in claim 1 wherein the microprocessor includes a 16- or 32-bit MPU for image analysis.

14. The interactive toy as claimed in claim 1 wherein in the microprocessor includes a routine for interactive game play, the routine causing the toy to relate to a user the need to perform one action, and then checking whether the action has been correctly performed.

15. The interactive toy as claimed in claim 14 including determining the right action relative to a preprogrammed pattern, and providing feedback to a user by causing the toy to react with different selected movements, the movement including selectively at least one of shaking or nodding of a reactive portion or an emission of a sound output.

16. The interactive toy as claimed in claim 1 wherein the toy is a doll including a plush, soft or hard plastic head and body; and the CMOS image sensor has a resolution of about or selectively less than 1M pixels.

17. An interactive toy comprising:

a body having a non-reactive portion and a reactive portion;

a CMOS image sensor with the body for capturing an image in the vicinity of the body;

a microprocessor for processing the captured image and generating instructions in response to the processed image, the instructions being for causing operation of the reactive portion of the body, and a communication module wherein the toy is connectable with a digital input device thereby to link the toy with digital input device through at least one of a USB, Bluetooth, Zigbee or WiFi communication protocol whereby the toy is configured to receive at least one of a predefined object set, voice, melody, song or sound effect from the digital input device;

wherein the microprocessor is for analyzing moving pixels of the sensor thereby to monitor the relative position and moving patterns of pixels, and to infer a connection with a body part of a user of the toy, thereby having the toy be user independent and not require training the toy for use respective to a user;

the microprocessor includes a routine for analyzing predefined objects in the vicinity of the body, and classifying the objects into different predefined categories of shapes, wherein the object analysis permits the identification of an object independently of the object orientation;

at least one motor and gear box for effecting movement of an element of the reactive portion, the element being at least one of ears, eyes, head, hands, legs or other body component;

at least one of a mirror or a light beam from an LED mounted in the body, the location of the mounting being for guiding a user of the toy to face the image sensor; and a human gesture command element, the operation of the element being for use to select respectively different games for the toy.

18. A method of playing with an interactive toy, wherein the interactive toy comprises a body having a non-reactive portion and a reactive portion; a CMOS image sensor with the body for capturing an image in the vicinity of the body; and a microprocessor for processing the captured image; wherein the microprocessor implements the steps of:

generating instructions in response to the processed image;

operating the reactive portion of the body in accordance with the instructions;

analyzing moving pixels of the sensor thereby to monitor the relative position and moving patterns of pixels;

inferring a connection with a body part of a user of the toy, thereby having the toy be user independent and not require training the toy for use respective to a user;

analyzing predefined objects in the vicinity of the body;

classifying the objects into different predefined categories of shapes, wherein the object analysis permits the identification of an object independently of the object orientation;

effecting movement of an element of the reactive portion, the element being at least one of ears, eyes, head, hands, legs or other body component;

guiding a user of the toy to face the image sensor with at least one of a mirror or a light beam from an LED mounted in the body, and operating a human gesture command element to select respectively different games for the toy.

19. The method of claim 18 including analyzing a pattern of motion in the vicinity of the body, and classifying the pattern into different predefined categories of motion.

20. The method of claim 19 including selecting the categories of motion of a human from the group consisting of crouching down, standing up, jumping, raising one arm, raising two arms, waving one arm, waving two arms, clapping a hand, shaking a head, nodding a head, and relative non-motion.

21. The method of claim 18 including effecting movement of an element of the reactive portion, the element being at least one of ears, eyes, head, hands, legs or other body component.

22. The method of claim 18 including operating the microprocessor when the body parts or objects are relatively fully visible, and having an aperture of a lens on the image sensor formed whereby the operation of the microprocessor is effectively functional when the user is within 1.5 meters from the image sensor.

23. An interactive toy comprising:

a body having a non-reactive portion and a reactive portion;

a CMOS image sensor with the body for capturing an image in the vicinity of the body;

a microprocessor for processing the captured image and generating instructions in response to the processed image, the instructions being for causing operation of the reactive portion of the body;

wherein the microprocessor is for analyzing moving pixels of the sensor thereby to monitor the relative position and moving patterns of pixels, and to infer a connection with a body part of a user of the toy, thereby having the toy be user independent and not require training the toy for use respective to a user; and the microprocessor includes a routine for analyzing predefined objects in the vicinity of the body, and classifying the objects into different predefined categories of shapes, wherein the object analysis permits the identification of an object independently of the object orientation.

24. The toy of claim 23 including a routine for determining the right action relative to a preprogrammed pattern, and providing feedback to a user by causing the toy to react with different selected movements, the movement including selectively at least one of shaking or nodding of a reactive portion or an emission of a sound output.

25. The toy of claim 23 including an actuator for effecting movement of an element of the reactive portion, the element being at least one of ears, eyes, head, hands, legs or other body component; at least one of a mirror or a light beam from an LED mounted in the body for guiding a user of the toy to face the image sensor, and a human gesture command element to select respectively different games for the toy.

* * * * *